US005350466A

United States Patent [19]

Larsen, Jr. et al.

[11] Patent Number: 5,350,466

[45] Date of Patent: Sep. 27, 1994

[54] CREEP RESISTANT TITANIUM ALUMINIDE ALLOY

[75] Inventors: Donald E. Larsen, Jr., Muskegon, Mich.; Prabir R. Bhowal, Huntington; Howard F. Merrick, Cheshire, both of Conn.

[73] Assignees: Howmet Corporation, Greenwich, Conn.; Avco Corporation, Providence, R.I.

[21] Appl. No.: 94,297

[22] Filed: Jul. 19, 1993

[51] Int. Cl.[5] ..... C22C 14/00

[52] U.S. Cl. ..... 148/421; 148/669; 148/670; 420/418; 420/421

[58] Field of Search ..... 148/421, 669, 670; 420/418, 421

[56] References Cited

U.S. PATENT DOCUMENTS

| | | | |
|---|---|---|---|
| 2,880,087 | 3/1959 | Jaffee | 75/175.5 |
| 3,203,794 | 8/1965 | Jaffee et al. | 75/175.5 |
| 4,294,615 | 10/1981 | Blackburn et al. | 75/175.5 |
| 4,661,316 | 4/1987 | Hashimoto et al. | 420/418 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,857,268 | 8/1989 | Huang et al. | 420/418 |
| 4,879,092 | 11/1989 | Huang | 420/418 |
| 4,902,447 | 2/1990 | Khanna et al. | 552/207 |
| 4,916,030 | 4/1990 | Christodoulou et al. | 428/614 |
| 5,080,860 | 1/1992 | Huang | 420/418 |
| 5,082,506 | 1/1992 | Huang | 148/2 |
| 5,082,624 | 1/1992 | Huang | 420/418 |
| 5,093,148 | 3/1992 | Christodoulou et al. | 427/37 |
| 5,098,653 | 3/1992 | Shyh-Chin | 420/418 |
| 5,196,162 | 3/1993 | Maki et al. | 420/418 |
| 5,207,982 | 5/1993 | Nazmy et al. | 420/418 |
| 5,226,985 | 7/1993 | Kim et al. | 148/669 |
| 5,256,202 | 10/1993 | Hanamura et al. | 148/670 |
| 5,284,620 | 2/1994 | Larsen, Jr. | 148/669 |

OTHER PUBLICATIONS

"Effect of Rapid Solidification in $L1_0$ TiAl Compound Alloys", to appear in ASM symposium proceedings on Enhanced Properties in Structural Metals Via Rapid Solidification, Materials Week, '86, Oct. 6–9, 1986, 7 pages.

Research, Development and Prospects of TiAl Intermetallic Compound Alloys; Titanium and Zirconium, vol. 33, No. 3, 159 (Jul. 1985), 19 pages.

*Primary Examiner*—Upendra Roy

*Attorney, Agent, or Firm*—Flynn, Thiel, Boutell & Tanis

[57] ABSTRACT

Creep resistant titanium aluminide alloy article consisting essentially of, in atomic %, about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium. The article has a heat treated microstructure including gamma phase, alpha-two phase and at least one additional particulate phase including, one or more or W, Mo, and Si dispersed as distinct regions in the microstructure.

10 Claims, 3 Drawing Sheets

CREEP RESISTANT TITANIUM ALUMINIDE ALLOY

FIELD OF THE INVENTION

The present invention relates to titanium aluminide alloys and, more particularly, to a gamma titanium aluminide alloy having dramatically improved high temperature creep resistance to increase the maximum use temperature of the alloy over currently available titanium aluminide alloys developed for aircraft use.

BACKGROUND OF THE INVENTION

The ongoing search for increased aircraft engine performance has prompted materials science engineers to investigate intermetallic compounds as potential replacement materials for nickel and cobalt base superalloys currently in widespread use for gas turbine engine hardware. Of particular interest over the past decade have been gamma or near-gamma titanium aluminides as a result of their low density and relatively high modulus and strength at elevated temperatures.

Modifications have been made to the titanium aluminide composition in attempts to improve the physical properties and processability of the material. For example, the ratio of titanium to aluminum has been adjusted and various alloying elements have been introduced in attempts to improve ductility, strength, and/or toughness. Moreover, various processing techniques, including thermomechanical treatments and heat treatments, have been developed to this same end.

An early effort to this end is described in Jaffee U.S. Pat. No. 2,880,087 which discloses titanium aluminide alloys having 8–34 weight % Al and additions of 0.5 to 5 weight % of beta stabilizing alloying elements such as Mo, V, Nb, Ta, Mn, Cr, Fe, W, Co, Ni, Cu, Si, and Be. Also see Jaffee Canadian Patent 220,571.

More recent efforts to this end are described in U.S. Pat. No. 3,203,794 providing optimized aluminum contents, U.S. Pat. No. 4,661,316 providing a Ti60-70Al30-36Mn0.1-5.0 alloy (weight %) optionally including one or more of Zr0.6-2.8Nb0.6-4.0V1.6-1.9W0.5-1.2Mo0.5-1.2 and C0.02-0.12, U.S. Pat. No. 4,836,983 providing a Ti54-57Al39-41Si4-5 (atomic %) alloy, U.S. Pat. No. 4,842,817 providing a Ti48-47Al46-49Ta3-5 (atomic %) alloy, U.S. Pat. No. 4,842,819 providing a Ti54-48Al45-49Cr1-3 (atomic %) alloy, U.S. Pat. No. 4,842,820 providing a boron-modified TiAl alloy, U.S. Pat. No. 4,857,268 providing a Ti52-46Al46-50V2-4 (atomic %) alloy, U.S. Pat. No. 4,879,092 providing a Ti50-46Al46-50Cr1-3Nb1-5 (atomic %) alloy, U.S. Pat. No. 4,902,474 providing a Ti52-47Al42-46Ga3-7 (atomic %) alloy, and U.S. Pat. No. 4,916,028 providing a Ti51-43Al46-50Cr1-3Nb1-5Co0.05-0.2 (atomic %) alloy.

U.S. Pat. No. 4,294,615 describes a titanium aluminide alloy having a composition narrowly selected within the broader prior titanium aluminide compositions to provide a combination of high temperature creep strength together with moderate room temperature ductility. The patent investigated numerous titanium aluminide compositions set forth in Table 2 thereof and describes an optimized alloy composition wherein the aluminum content is limited to 34–36 weight % and wherein vanadium and carbon can be added in amounts of 0.1 to 4 weight %. and 0.1 weight %, respectively, the balance being titanium. The '615 patent identifies V as an alloying element for improving low temperature ductility and Sb, Bi, and C as alloying elements for improving creep rupture resistance. If improved creep rupture life is desired, the alloy is forged and annealed at 1100° to 1200° C. followed by aging at 815° to 950° C.

U.S. Pat. No. 5,207,982 describes a titanium aluminide alloy including one of B, Ge or Si as an alloying element and high levels of one or more of Hf, Mo, Ta, and W as additional alloying elements to provide high temperature oxidation/corrosion resistance and high temperature strength.

The present invention provides a titanium aluminide material alloyed with certain selected alloying elements in certain selected proportions that Applicants have discovered yield an unexpected improvement in alloy creep resistance while maintaining other alloy properties of interest.

SUMMARY OF THE INVENTION

The present invention provides a titanium aluminide alloy composition consisting essentially of, in atomic %, about 44 to about 49 Al, about 0.5 to about 4.0 Nb, about 0.25 to about 3.0 Mn , about 0.1 to less than about 1.0 Mo, about 0.1 to less than about 1.0 W, about 0.1 to about 0.6 Si and the balance titanium. Preferably, Mo and W each do not exceed about 0.90 atomic %.

A preferred titanium aluminide alloy composition in accordance with the invention consists essentially of, in atomic % , about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium. An even more preferred alloy composition consists essentially of, in atomic %, about 47 Al, 2 Nb, 1 Mn, 0.5 W, 0.5 Mo, 0.2 Si and the balance Ti.

The titanium aluminide alloy composition of the invention can be investment cast, hot isostatically pressed, and heat treated. In general, the heat treated titanium aluminide composition of the invention exhibits greater creep resistance and ultimate tensile strength than previously developed titanium aluminide alloys. The heat treated alloy of preferred composition set forth above exhibits creep resistance that is as much as 10 times greater than previously developed titanium aluminide alloys while providing a room temperature ductility above 1%.

The heat treated microstructure comprises predominantly gamma (TiAl) phase and a minor amount of (e.g. 5 volume %) alpha-two ($Ti_3Al$) phase. At least one additional phase bearing at least one of W, Mo, and Si is dispersed as distinct particulate-type regions intergranularly of the gamma and alpha-two phases.

The aforementioned objects and advantages of the present invention will become more readily apparent from the following detailed description taken with the drawings.

DETAILED DESCRIPTION

Figure 1A:
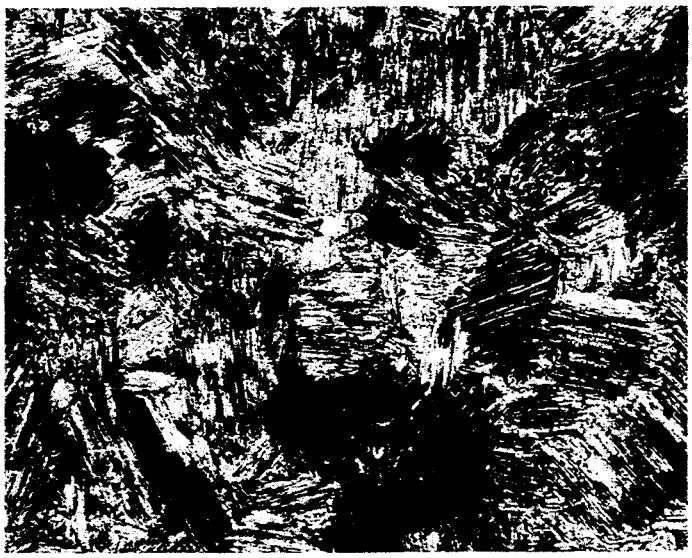
FIGS. 1A, 1B and 1C are photomicrographs of the as-cast microstructure of the alloy of the invention taken at 100×, 200×, and 500×, respectively.

The present invention provides a creep resistant titanium aluminide alloy composition that, in general, exhibits greater creep resistance and ultimate tensile strength than previously developed titanium aluminide alloys in the heat treated condition, while maintaining room temperature ductility above 1%. The heat treated alloy of preferred composition set forth herebelow exhibits creep resistance that is as much as 10 times greater than previously developed titanium aluminide alloys.

The titanium aluminide alloy composition in accordance with the invention consists essentially of, in atomic %, about 44 to about 49 Al, about 0.5 to about 4.0 Nb, about 0.25 to about 3.0 Mn, about 0.1 to less than about 1.0 Mo and preferably not exceeding about 0.90 atomic %, about 0.1 to less than about 1.0 W and preferably not exceeding about 0.90 atomic %, about 0.1 to about 0.6 Si and the balance titanium.

A preferred titanium aluminide alloy composition in accordance with the invention consists essentially of, in atomic %, about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium. A preferred nominal alloy composition consists essentially of, in atomic %, about 47 Al, 2 Nb, 1 Mn, 0.5 W, 0.5 Mo, 0.2 Si and the balance Ti.

As will become apparent herebelow, the titanium aluminide alloy composition should include Si in the preferred amount in order to provide optimum alloy creep resistance that is unexpectedly as much as ten (10) times greater than that exhibited by previously known titanium aluminide alloys. In particular, when the Si content of the alloy is about 0.15 to about 0.3 atomic %, the heat treated alloy exhibits creep resistance as much as ten (10) times greater than previously known titanium aluminide alloys as the Examples set forth herebelow will illustrate. Even when the Si content is below the preferred level yet within the general range specified hereabove (e.g. about 0.1 to about 0.6 atomic %), the creep resistance of the alloy of the invention is superior to that exhibited by previously known titanium aluminide alloys as the examples set forth herebelow will illustrate.

The titanium aluminide alloy of the invention can be melted and cast to ingot form in water cooled metal (e.g. Cu) ingot molds. The ingot may be worked to a wrought, shaped product. Alternately, the alloy can be melted and cast to net or near net shapes in ceramic investment molds or metal permanent molds. The alloy of the invention can be melted using conventional melting techniques, such as vacuum arc melting and vacuum induction melting. The as-cast microstructure is described as lamellar containing laths of the gamma phase (TiAl) and alpha-two phase ($Ti_3Al$).

Typically, the cast alloy is hot isostatically pressed to close internal casting defects (e.g. internal voids). In general, the as-cast alloy is hot isostatically pressed at 2100°–2400° F. at 10–25 ksi for 1–4 hours. A preferred hot isostatic press is conducted at a temperature of 2300° F. and argon pressure of 25 ksi for 4 hours.

The alloy is heat treated to a lamellar or duplex microstructure comprising predominantly gamma phase as equiaxed grains and lamellar colonies, a minor amount of alpha-two ($Ti_3Al$) phase and additional uniformly distributed phases that contain W or Mo or Si, or combinations thereof with one another and/or with Ti.

The heat treatment is conducted at 1650° to 2400° F. for 1 to 50 hours. A preferred heat treatment comprises 1850° F. for 50 hours.

The alpha-two phase typically comprises about 2 to about 12 volume % of the heat treated microstructure.

Figure 3:
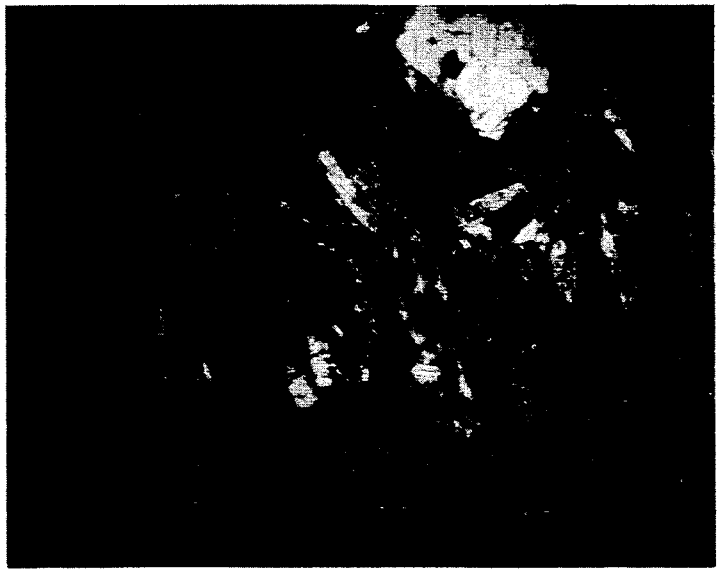
FIG. 3 is a scanning electron micrograph at 250× of the heat treated microstructure of the aforementioned alloy of the invention.
Figure 4A:
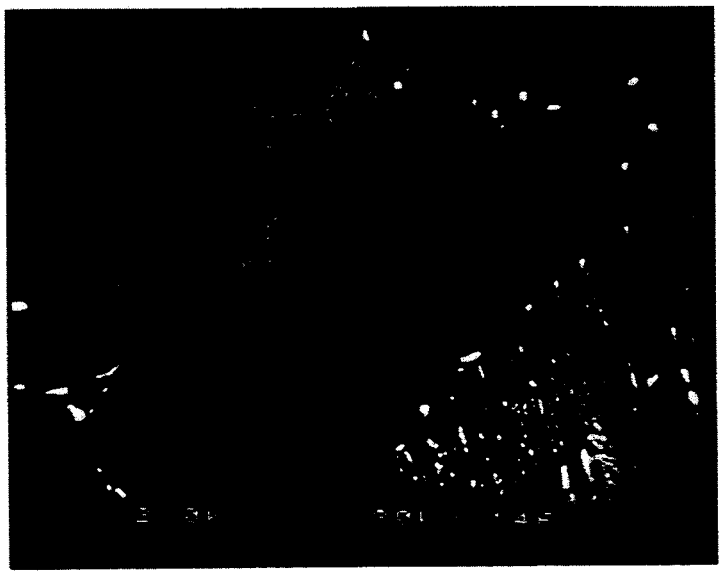
FIGS. 4A and 4B are scanning electron micrographs at 2000× of the microstructure of FIG. 3 taken at regions 4A and 4B, respectively, showing dispersed phases containing W, Mo, and/or Si.
Figure 4B:
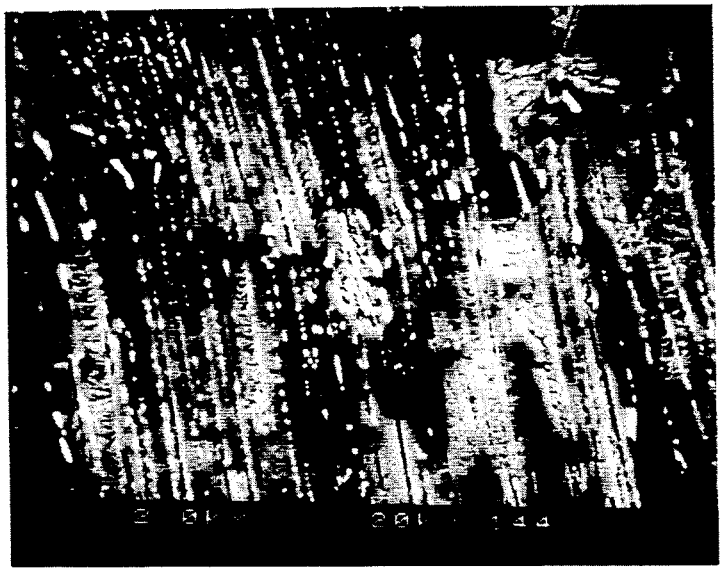

One or more additional phases bearing W or Mo or Si, or combinations thereof with one another and/or Ti, are present as distinct particulate-type regions disposed in lamellar networks intergranularly of the gamma and alpha-two phases and also disposed as distinct regions at grain boundaries of gamma grains (dark phase) as illustrated in FIGS. 3 and 4A–4B. In these Figures, the additional phases appear as distinct white regions.

The following example is offered for purposes of illustrating, not limiting, the scope of the invention.

EXAMPLE

Specimen bars of the titanium aluminide alloys listed in Tables I and II herebelow were made. The first-listed alloy (Ti-47Al-2Nb-1Mn-0.5W-0.5Mo-0.2Si) and second-listed alloy (Ti-47Al-2Nb-1Mn-0.5W-0.5Mo-0.1Si) are representative of the present invention and are compared to other known comparison titanium aluminide alloys. The last three alloys listed in Table I and II included titanium boride dispersoids in the volume percentages set forth.

The individual listed alloys were vacuum arc melted at less than 10 micron atmosphere and then cast at a melt superheat of approximately 50° F. into an investment mold having a facecoat comprising yttria or zirconia. For the alloys containing titanium boride dispersoids, the dispersoids were added to the melt as a master sponge material prior to melt casting into the mold. Each alloy was solidified in the investment mold under vacuum in the casting apparatus and then air cooled to ambient. Cylindrical cast bars of $\frac{5}{8}$ inch diameter and 8 inches length were thereby produced.

Figure 1B:
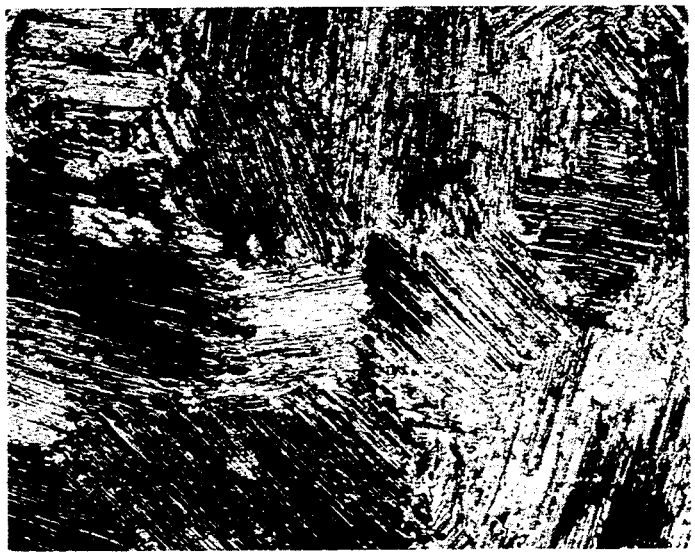
Figure 1C:
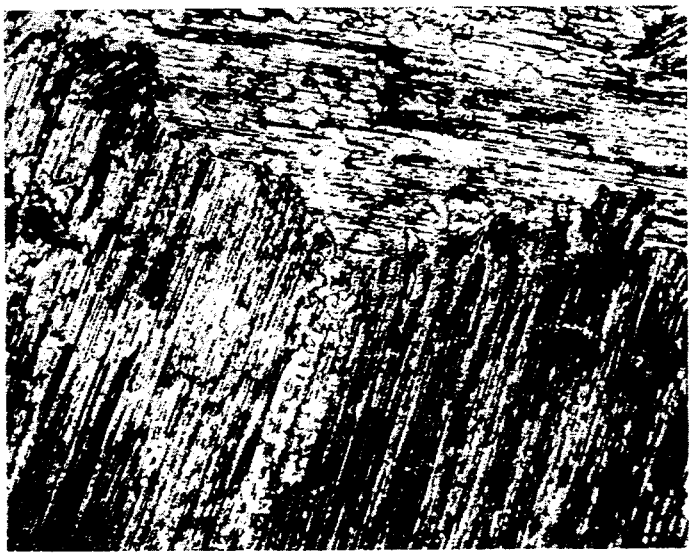

The as-cast microstructure of the first-listed alloy of the invention (Ti-47Al-2Nb-1Mn-0.5W-0.5Mo-0.2Si) is shown in FIGS. 1A, 1B, and 1C and comprises a lamellar structure containing laths of gamma phase and alpha-two phase. The as-cast microstructure of the second-listed alloy of the invention was similar.

Test specimens for creep testing and tensile testing were machined from the cast bars. The creep test specimens were machined in accordance with ASTM test standard E8. The tensile test specimens were machined in accordance with ASTM test standard E8.

After machining, the test specimens of all alloys were hot isostatically pressed at 2300° F. and argon pressure of 25 ksi for 4 hours. Then, alloy specimens of the invention were heat treated at 1850° F. for 50 hours in an argon atmosphere and allowed to furnace cool to ambient by furnace power shutoff as indicated in Tables I and II. The other comparison alloys were heat treated in the manner indicated in Tables I and II.

Figure 2A:
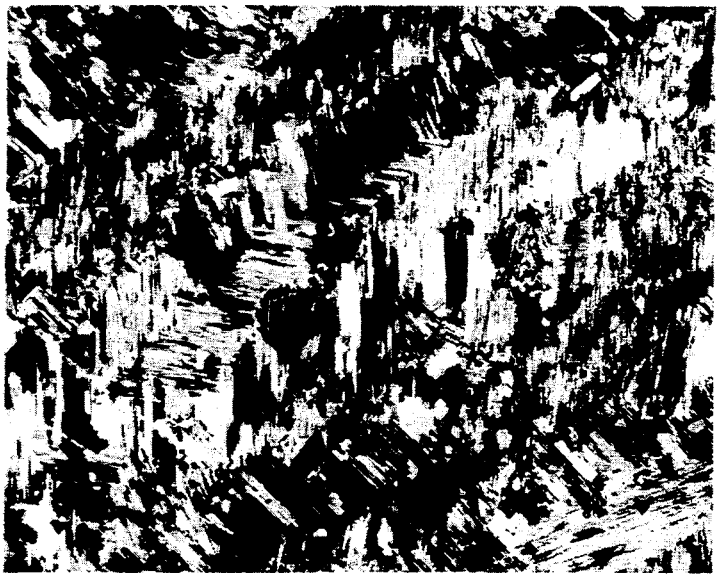
FIGS. 2A, 2B and 2C are photomicrographs of the heat treated microstructure of the aforementioned alloy of the invention taken at 100×, 200×, and 500×, respectively.
Figure 2B:
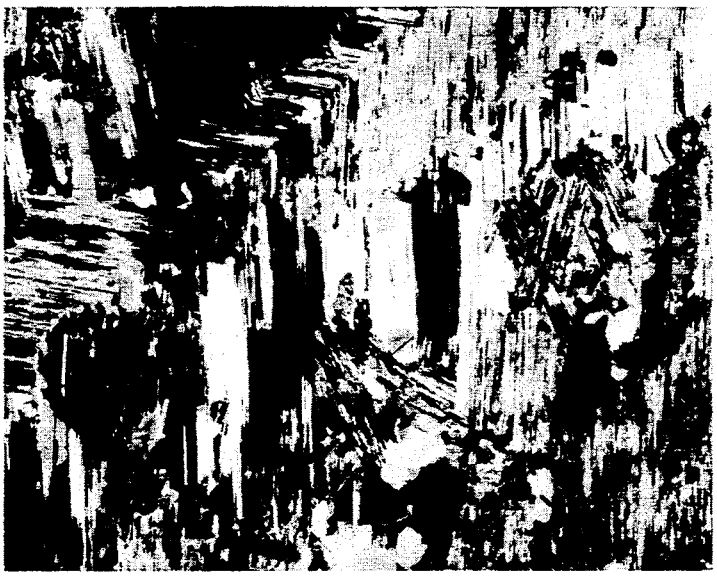
Figure 2C:
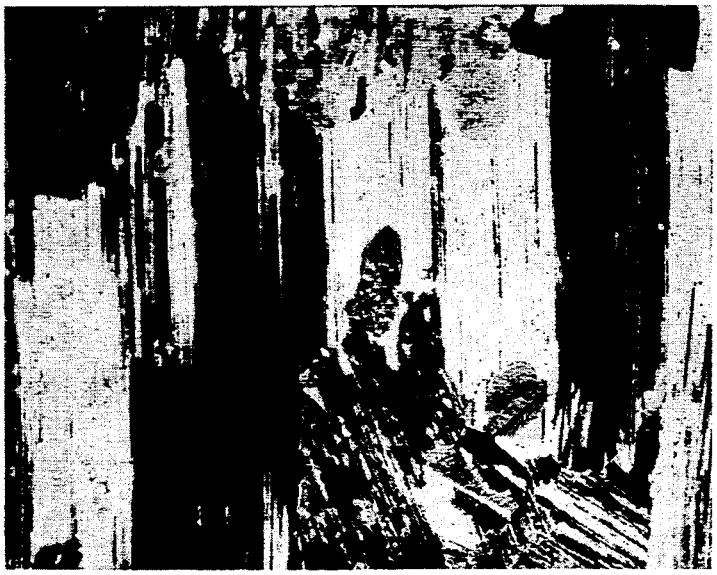

The heat treated microstructure of the first-listed alloy of the invention (Ti-47Al-2Nb-1Mn-0.5W-0.5Mo-0.2Si) is shown in FIGS. 2A, 2B, and 2C. The heat treated microstructure comprises predominantly gamma (TiAl) phase and a minor amount (e.g. 5 volume %) alpha-two ($Ti_3Al$) phase. Additional phases including W, Mo, or Si or combinations thereof with one another and/or with Ti are distributed as distinct regions intergranularly uniformly throughout the gamma and alpha-two phases.

FIG. 3 is a scanning electron micrograph of the alloy specimen shown in FIGS. 2A, 2B and 2C illustrating the additional phases distributed intragranularly and intergranularly relative to the gamma phase and alpha-two phase after heat treatment. FIGS. 4A and 4B illustrate that the additional phases are present as distinct regions (appearing as white regions) disposed as lamellar networks at grain boundaries within the lamellar gamma phase/alpha-two phase lath network and also disposed as distinct regions intergranularly and intragranularly relative to isolated gamma phase regions (dark phase in FIGS. 3 and 4A).

Heat treated specimens were subjected to steady state creep testing in accordance with ASTM test standard E8 at the elevated test temperatures and stresses set forth in Table I. The time to reach 0.5% elongation was measured. The average time to reach 0.5% elongation typically for 3 specimens is set forth in Table I.

TABLE I

CAST GAMMA ALLOY CREEP PROPERTY COMPARISON TABLE TIME TO 0.5% CREEP IN HOURS

| ALLOY (Atomic %) | CREEP PARAMETER 1200F/ 40KSI | 1440F/ 20KSI | 1500F/ 20KSI |
|---|---|---|---|
| Ti—47Al—2Nb—1Mn—0.5W—0.5Mo—0.2Si | 930 | 325 | 34 |
| Ti—47Al—2Nb—1Mn—0.5W—0.5Mo—0.1Si | 688 | 85 | 18 |
| 20Ti—48Al—2Nb—2Cr* | 95 | 13 | 2.4 |
| Ti—48Al—2Nb—2Mn** | N.D. | 120 | 2.1 |
| Ti—46Al—4Nb—1W*** | N.D. | N.D. | 10.3 |
| Ti—47Al—2Nb—2Mn + 0.8v % TiB2 XD | 460 | 63.3 | 10.5 |
| Ti—45Al—2Nb—2Mn + 0.8v % TiB2 XD | 143 | 16.5 | 2.5 |
| Ti—48Al—2V + 7 vol % TiB2 XD | N.D. | N.D. | 8.8 |

All test specimens machined from 5/8" diameter cast bars, HIP processed at 2300F/25ksi/4hrs, and heat treated at 1850F/50hrs unless otherwise noted below.
*Heat treated at 2375F/20hrs/GFC (gas fan cool)
**Heat treated at 2465F/0.5hr/2375F10hrs/GFC
***Heat treated at 2415F/0.5hr/2315F10hrs/GFC
N.D. - not determined Heat treated specimens also were subjected to tensile testing in accordance with ASTM test standard E8 at room temperature and at 1400° F. as set forth in Table II. The ultimate tensile strength (UTS), yield strength (YS), and elongation (EL) are set forth in Table II. The average UTS, YS, and EL typically for 3 specimens is set forth in Table II.

TABLE II

CAST CAMMA ALLOY TENSILE PROPERTY COMPARISON TABLE

| ALLOY (Atomic %) | 70F UTS (ksi) | 70F YS (ksi) | 70F EL (%) | 1400F UTS (ksi) | 1400F YS (ksi) | 1400F EL (%) |
|---|---|---|---|---|---|---|
| 10Ti—47Al—2Nb—1Mn—0.5W—0.5Mo—0.2Si | 72.1 | 59.9 | 1.2 | 76.2 | 51.3 | 10.7 |
| Ti—47Al—2Nb—1Mn—0.5W—0.5Mo—0.1Si | 68.8 | 56.7 | 1.3 | N.D. | N.D. | N.D. |
| Ti—48Al—2Nb—2Cr* | 64.2 | 47.0 | 2.3 | 56.7 | 39.0 | 58.0 |
| Ti—48Al—2Nb—2Mn** | 58.8 | 40.1 | 2.0 | 59.3 | 40.3 | 33.0 |
| Ti—46Al—5Nb—1W*** | 79.7 | 67.4 | 0.9 | N.D. | N.D. | N.D. |
| Ti—47Al—2Nb—2Mn + 0.8 v % TiB2 XD | 69.8 | 85.3 | 1.2 | 66.4 | 49.8 | 17.8 |
| Ti—45Al—2Nb—2Mn + 0.8 v % TiB2 XD | 104.2 | 87.7 | 1.5 | 73.2 | 59.9 | 6.8 |
| Ti—48Al—2V + 7.0 v % TiB2 XD | 89.2 | 78.4 | 0.6 | N.D. | N.D. | N.D. |

All test specimens machined from 5/8" diameter cast bars, HIP processed at 2300F/25ksi/4hrs, and heat treated at 1850F/50hrs unless otherwise noted below.
*Heat treated at 2375F/20hrs/GFC
**Heat treated at 2465F/0.5hr/2375F10hrs/GFC
***Heat treated at 2415F/0.5hr/2315F10hrs/GFC
N.D. - not determined Referring to Tables I and II, it is apparent that the first-listed alloy of the invention (Ti-47Al-2Nb-1Mn-0.5W-0.5Mo-0.2Si) exhibited at 1200° F. an unexpected almost ten-fold improvement in creep resistance versus the other comparison titanium aluminide alloys not containing titanium diboride dispersoids. At 1400° F. and 1500° F., the creep resistance of the first-listed alloy of the invention was at least twice that of the other comparison titanium aluminide alloys not containing dispersoids.

With respect to the titanium aluminide alloys containing titanium diboride dispersoids, the creep resistance of the first-listed alloy of the invention (Ti-47Al-2Nb-1Mn-0.5W-0.5Mo-0.2Si) was at least twice that of the dispersoid-containing alloys at 1200° F. At higher test temperatures, the creep resistance of the first-listed alloy of the invention was at least three times greater than that of the dispersoid-containing alloys.

The room temperature tensile test data set forth in Table II indicate substantial improvement in the UTS (ultimate tensile strength) and YS (yield strength) of the first-listed alloy of the invention versus the Ti-48Al-2Nb-2Cr and Ti-48Al-2Nb-2Mn comparison alloys. The tensile test data for the first-listed alloy of the invention are comparable to the dispersoid-containing Ti-47Al-2Nb-2Mn alloy containing 0.8 volume % (v % in Tables I and II) $TiB_2$.

The 1400° F. tensile test data set forth in Table II indicate that the UTS and YS of the first-listed alloy of the invention are substantially improved relative to the other comparison titanium aluminide alloys with or without dispersoids. Only the Ti-45Al-2Nb-2Mn alloy containing 0.8 volume % $TiB_2$ was comparable to the alloy of the invention in high temperature tensile properties.

The aforementioned improvements in creep resistance and tensile properties are achieved in the first-listed alloy of the invention while providing a room temperature elongation of greater than 1%, particularly 1.2%.

The dramatic improvement in creep resistance illustrated in Table I for the first-listed alloy of the invention may allow an increase in the maximum use temperature of titanium aluminide alloys in a gas turbine engine service from 1400° F. (provided by previously developed titanium aluminide alloys) to 1500° F. and possibly 1600° F. for the creep resistant alloy of the invention. The first-listed alloy of the invention thus could offer a 100°-200° F. improvement in gas turbine engine use temperature compared to the comparison titanium aluminide alloys. Moreover, since the titanium aluminide alloy of the invention has a substantially lower density than currently used nickel and cobalt base superalloys, the alloy of the invention has the potential to replace equiaxed nickel and cobalt base superalloy components in aircraft and industrial gas turbine engines.

Referring again to Table I, it is apparent that the second-listed alloy of the invention (Ti-47Al-2Nb-1Mn-0.5W-0.5Mo-0.1Si) exhibited improved creep resistance versus the other comparison titanium aluminide alloys not containing titanium dispersoids. With respect to the titanium aluminide alloys containing titanium boride dispersoids, the creep resistance of the second-listed alloy of the invention (Ti-47Al-2Nb-1Mn-0.5W-0.5Mo-0.1Si) also was improved.

The room temperature tensile test data set forth in Table IV indicate that the UTS and YS of the second-listed alloy of the invention were comparable to the other comparison alloys.

The aforementioned improvements in creep resistance and tensile properties are achieved in the second-listed alloy of the invention while providing a room temperature elongation of greater than 1%, particularly 1.3%.

Although the titanium aluminide alloy of the invention has been described in the Example hereabove as used in investment cast form, the alloy is amenable for use in wrought form as well. Modifications and variations of the present invention are possible in light of the above teachings. It is therefore to be understood that within the scope of the appended claims, the invention may be practiced otherwise than as specifically described herein.

The embodiments of the invention in which an exclusive property or privilege is claimed are defined as follows:

1. Titanium aluminide alloy composition consisting essentially of, in atomic %, about 44 to about 49 Al, about 0.5 to about 4.0 Nb, about 0.25 to about 3.0 Mn, about 0.1 to less than about 1.0 Mo, about 0.1 to less than about 1.0 W, about 0.1 to about 0.6 Si and the balance titanium.

2. The alloy composition of claim 1 wherein Mo and W each do not exceed about 0.90 atomic %.

3. An investment casting having the composition of claim 1.

4. Titanium aluminide alloy composition consisting essentially of, in atomic %, about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium.

5. An investment casting having the composition of claim 4.

6. Titanium aluminide alloy composition consisting essentially of, in atomic %, about 47 Al, 2 Nb, 1 Mn, 0.5 W, 0.5 Mo, 0.2 Si and the balance Ti.

7. A creep resistant titanium aluminide alloy article consisting essentially of, in atomic %, about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium, said article having a microstructure including gamma phase and at least one additional phase bearing at least one of W, Mo, and Si dispersed as distinct regions in the microstructure.

8. The article of claim 7 wherein the microstructure comprises a majority of gamma phase with a minority of alpha-two phase present.

9. The article of claim 7 wherein the additional phase is present as distinct regions located intergranularly of the gamma and alpha-two phases.

10. A creep resistant gas turbine engine component consisting essentially of, in atomic %, about 45 to about 48 Al, about 1.0 to about 3.0 Nb, about 0.5 to about 1.5 Mn, about 0.25 to about 0.75 Mo, about 0.25 to about 0.75 W, about 0.15 to about 0.3 Si and the balance titanium, said article having a microstructure including gamma phase and at least one additional phase including W, Mo, or Si, or combinations thereof, dispersed as distinct regions in the microstructure.

* * * * *